US012607195B2

(12) United States Patent
Jeon

(10) Patent No.: US 12,607,195 B2
(45) Date of Patent: Apr. 21, 2026

(54) TURBOPUMP CAPABLE OF BALANCING AXIAL THRUST

(71) Applicant: KOREA AEROSPACE RESEARCH INSTITUTE, Daejeon (KR)

(72) Inventor: Seong Min Jeon, Daejeon (KR)

(73) Assignee: KOREA AEROSPACE RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 18/816,024

(22) Filed: Aug. 27, 2024

(65) Prior Publication Data

US 2025/0075707 A1 Mar. 6, 2025

(30) Foreign Application Priority Data

Sep. 1, 2023 (KR) ..... 10-2023-0116335

(51) Int. Cl.

| | |
|---|---|
| ***F04D 29/051*** | (2006.01) |
| ***F04D 17/10*** | (2006.01) |
| ***F04D 29/041*** | (2006.01) |
| ***F04D 29/056*** | (2006.01) |
| ***F04D 29/10*** | (2006.01) |

(52) U.S. Cl.

CPC ..... *F04D 29/051* (2013.01); *F04D 17/10* (2013.01); *F04D 29/041* (2013.01); *F04D 29/056* (2013.01); *F04D 29/102* (2013.01)

(58) Field of Classification Search

CPC ..... F04D 29/051; F04D 17/10; F04D 29/041; F04D 29/056; F04D 29/102

See application file for complete search history.

(56) References Cited

U.S. PATENT DOCUMENTS

| | | | | | |
|---|---|---|---|---|---|
| 1,020,699 | A * | 3/1912 | Kieser | F04D 29/2266 | 277/420 |
| 4,867,633 | A * | 9/1989 | Gravelle | F04D 29/167 | 415/113 |
| 5,197,851 | A | 3/1993 | Girault | | |
| 5,385,442 | A * | 1/1995 | Lehe | F04D 29/2266 | 415/106 |
| 6,193,462 | B1 * | 2/2001 | Kubota | F04D 29/2266 | 415/106 |
| 9,951,786 | B2 * | 4/2018 | Elebiary | F04D 29/2266 | |
| 10,513,928 | B2 | 12/2019 | Bruurs | | |
| 2019/0085850 | A1 * | 3/2019 | Nagao | F04D 29/083 | |

FOREIGN PATENT DOCUMENTS

| | | | | |
|---|---|---|---|---|
| CN | 201162705 | | 12/2008 | |
| CN | 117145798 | | 12/2023 | |
| EP | 4187099 | | 5/2023 | |
| JP | 07004381 | | 1/1995 | |
| JP | 2002257083 | * | 9/2002 | F04D 29/22 |
| KR | 20060086960 | | 8/2006 | |
| KR | 20210097466 | | 8/2021 | |

* cited by examiner

*Primary Examiner* — Andrew J Marien

(74) *Attorney, Agent, or Firm* — Perman & Green, LLP

(57) ABSTRACT

A turbopump includes a casing, a rotational shaft rotatably supported on the casing, and an impeller mounted on a side of the rotational shaft and pressurizing a fluid flowing into the impeller from an inlet of the casing, wherein axial thrust is controlled as a clearance formed between the impeller and the casing in a length direction of the rotational shaft varies according to a fluid pressure difference between front and rear sides of the impeller.

14 Claims, 12 Drawing Sheets

TURBOPUMP CAPABLE OF BALANCING AXIAL THRUST

CROSS-REFERENCE TO RELATED APPLICATION

This application is based on and claims priority under 35 U.S.C. § 119 to Korean Patent Application No. 10-2023-0116335, filed on Sep. 1, 2023, in the Korean Intellectual Property Office, the disclosure of which is incorporated by reference herein in its entirety.

BACKGROUND

1. Field

The disclosure relates to a turbopump capable of balancing axial thrust.

2. Description of the Related Art

Turbopumps, also known as turbo molecular pumps, are used in various industries and laboratories, ranging from fuel supply systems of rocket engines to semiconductor and display manufacturing. Turbopumps pressurize fuel and oxidizer to high pressure and send the fuel and oxidizer to combustion chambers. A turbopump may include an inducer for drawing in fluid, an impeller for pressurizing the fluid by centrifugal force, and a turbine for driving the turbopump. Fuel and oxidizer entering from a fuel tank and an oxidizer tank pass through the inducer, are pressurized by the impeller, and then move to an engine. During use of the turbopump, constant pressure is not applied to front and rear sides of the impeller, and thus, the impeller may receive axial force that is called axial thrust. To ensure the durability and reliability of the turbopump, it may be necessary to properly control axial thrust.

According to a current method of passively controlling axial thrust, seals may be installed on shoulders provided in front of and behind the impeller to adjust the area of a shroud of the impeller and thus reduce a net load applied to the impeller. However, once the impeller is manufactured, a high-pressure region and a low-pressure region are fixed due to the seals, and thus, when axial thrust varies due to variation in the operation environment of the turbopump, it is difficult to actively respond to the variations in axial thrust. When the operation environment of the turbopump changes from initial design criteria or an unexpected excessive axial load is applied to the turbopump, axial thrust applied to the turbopump may not be properly controlled, causing damage to bearings of the turbopump and even damage to the entire rocket engine.

PRIOR ART DOCUMENTS

Patent Documents (Patent Document 1) Japanese Patent Application Publication No. 1991-346884

SUMMARY

Provided is a turbopump capable of automatically balancing axial thrust without additional axial-trust control structures.

Additional aspects will be set forth in part in the description which follows and, in part, will be apparent from the description, or may be learned by practice of the presented embodiments of the disclosure.

According to an aspect of the disclosure, a turbopump includes a casing, a rotational shaft rotatably supported on the casing, and an impeller mounted on a side of the rotational shaft and pressurizing a fluid flowing into the impeller from an inlet of the casing, wherein axial thrust is controlled as a clearance formed between the impeller and the casing in a length direction of the rotational shaft varies according to a fluid pressure difference between front and rear sides of the impeller.

When a load caused by a fluid pressure applied to the front side of the impeller is greater than a load caused by a fluid pressure applied to the rear side of the impeller, the impeller and the rotational shaft may move rearward, and when the load caused by the fluid pressure applied to the front side of the impeller is less than the load caused by the fluid pressure applied to the rear side of the impeller, the impeller and the rotational shaft may move forward.

When the impeller and the rotational shaft move rearward, a load caused by a pressure of the fluid pressing the impeller forward between the rear side of the impeller and the casing may increase, and when the impeller and the rotational shaft move forward, the load caused by the pressure of the fluid pressing the impeller forward between the rear side of the impeller and the casing may decrease.

The impeller may include a front shroud, a rear shroud, and a first protrusion. The rear shroud may be provided axially apart from the front shroud. The rear shroud may form a passage through which the fluid flows between the front shroud and the rear shroud and may form an internal space with the casing. The first protrusion may protrude axially from the rear shroud and form a clearance with the casing. The casing may include an opposing surface facing the rear shroud and forming the internal space with the rear shroud.

When a load caused by a fluid pressure applied to the front shroud is greater than a load caused by a fluid pressure applied to the rear shroud, the impeller and the rotational shaft may move rearward, and the clearance between the first protrusion and the casing may decrease. In addition, when the load caused by the fluid pressure applied to the front shroud is less than the load caused by the fluid pressure applied to the rear shroud, the impeller and the rotational shaft may move forward, and the clearance between the first protrusion and the casing may increase.

The casing may further include a first projection extending from a side of the opposing surface toward the first protrusion.

When a load caused by a fluid pressure applied to the front shroud is greater than a load caused by a fluid pressure applied to the rear shroud, the impeller and the rotational shaft may move rearward, the first protrusion may move toward the first projection and come into nearly contact with the first projection, and the fluid may not be discharged from the internal space. In addition, when the load caused by the fluid pressure applied to the front shroud is less than the load caused by the fluid pressure applied to the rear shroud, the impeller and the rotational shaft may move forward, the first protrusion may move away from the first protrusion, and an amount of the fluid discharged from the internal space may increase.

The impeller may further include a second protrusion protruding axially from the rear shroud and formed radially outward of the first protrusion, and the casing may further include a second projection extending from a side of the opposing surface toward the second protrusion.

A gap between the second protrusion and the opposing surface and a gap between the rear shroud and the second projection may be greater than a gap between the first protrusion and the casing.

The second projection may be located radially outward of the second protrusion.

A portion of the fluid discharged from the impeller may flow along the rear shroud, and another portion of the fluid discharged from the impeller may flow along a first channel formed in the casing. The impeller may further include a second channel located radially inward of the first protrusion and formed between the rear shroud and the rotational shaft.

The first protrusion may include a plurality of concave and convex portions on a surface thereof.

When a load caused by a fluid pressure applied to the front shroud is greater than a load caused by a fluid pressure applied to the rear shroud, the impeller and the rotational shaft may move rearward, and an amount of the fluid discharged from the internal space may decrease, and an amount of the fluid flowing from the impeller into the internal space may increase. In addition, when the load caused by the fluid pressure applied to the front shroud is less than the load caused by the fluid pressure applied to the rear shroud, the impeller and the rotational shaft may move forward, the amount of the fluid discharged from the internal space may increase, and the amount of the fluid flowing from the impeller into the internal space may decrease.

The second projection may include a first extension extending axially forward from the casing, and a first end portion extending radially inward from the first extension, wherein the second protrusion may include a second extension extending axially rearward from the rear shroud, and a second end portion extending radially outward from the second extension.

When a load caused by a fluid pressure applied to the front shroud is greater than a load caused by a fluid pressure applied to the rear shroud, the impeller and the rotational shaft may move rearward, a clearance between the first protrusion and the casing may decrease, and a clearance between the second protrusion and the second projection may increase. In addition, when the load caused by the fluid pressure applied to the front shroud is less than the load caused by the fluid pressure applied to the rear shroud, the impeller and the rotational shaft may move forward, the clearance between the first protrusion and the casing may increase, and the clearance between the second protrusion and the second projection may decrease.

The second protrusion and the second projection may overlap each other in at least one of an axial direction and a radial direction.

The first end portion and the second end portion may overlap each other in the axial direction, and the first end portion may overlap the rear shroud in the radial direction.

The fluid discharged from the impeller may flow into the internal space through: a clearance between the first end portion and the rear shroud; a space formed by the first extension, the first end portion, the second extension, and the second end portion; and a clearance between the first extension and the second end portion.

The turbopump may further include a first seal between the casing and the rotational shaft, a second seal provided between the casing and the rotational shaft at a position different from a position of the first seal and including an elastic member, and a bearing provided between the casing and the rotational shaft at a position different from the position of the second seal and elastically supported by the second seal.

The second seal may be axially rearward of the bearing and may maintain the bearing in an initial position between the casing and the rotational shaft, and the bearing may be between the first seal and the second seal in an axial direction.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
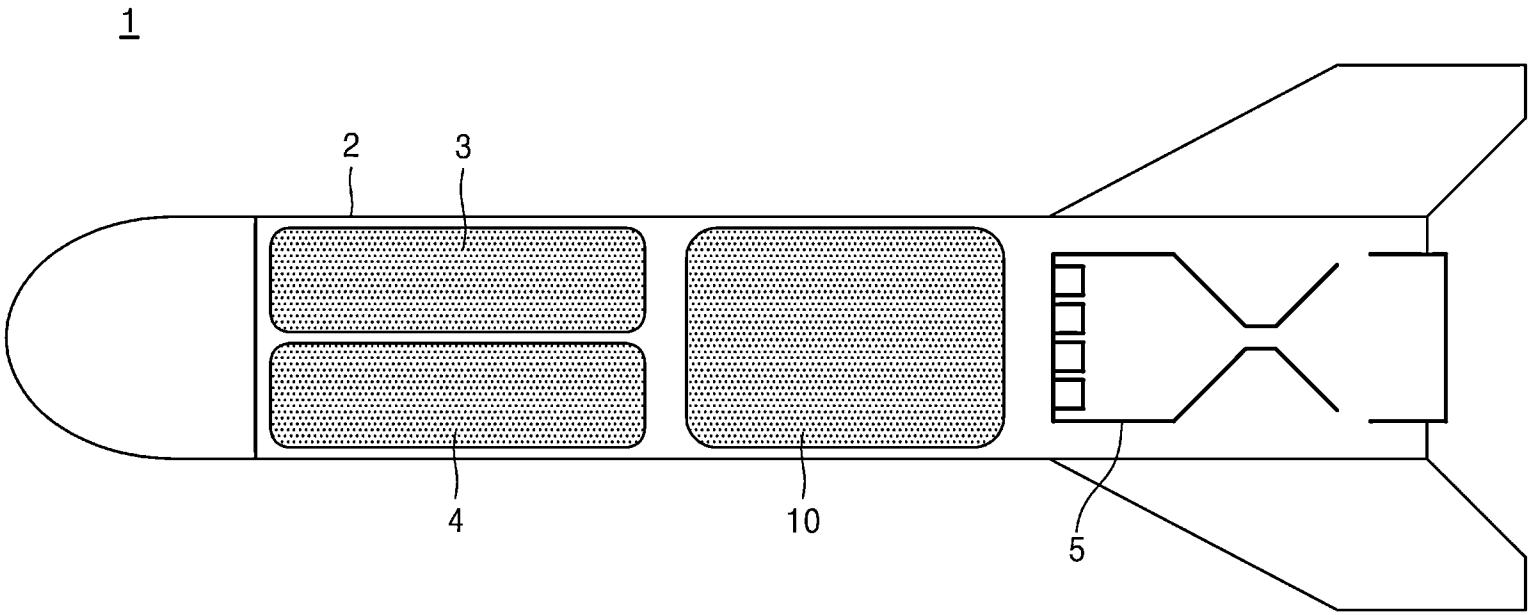
FIG. 1 is a view schematically illustrating a rocket including a turbopump according to embodiments.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Aspects of some embodiments of the present disclosure and methods of accomplishing the same may be understood more readily by reference to the detailed description of embodiments and the accompanying drawings. Hereinafter, embodiments will be described in more detail with reference to the accompanying drawings. The described embodiments, however, may have various modifications and may be embodied in different forms, and should not be construed as being limited to only the illustrated embodiments herein. Further, each of the features of the various embodiments of the present disclosure may be combined or combined with each other, in part or in whole, and technically various interlocking and driving are possible. Each embodiment may be implemented independently of each other or may be implemented together in an association. The described embodiments are provided as examples so that this disclosure will be thorough and complete, and will fully convey the aspects of the present disclosure to those skilled in the art, and it should be understood that the present disclosure covers all the modifications, equivalents, and replacements within the idea and technical scope of the present disclosure. Accordingly, processes, elements, and techniques that are not necessary to those having ordinary skill in the art for a complete understanding of the aspects of the present disclosure may not be described.

Unless otherwise noted, like reference numerals, characters, or combinations thereof denote like elements throughout the attached drawings and the written description, and thus, descriptions thereof will not be repeated. Further, parts that are not related to, or that are irrelevant to, the description of the embodiments might not be shown to make the description clear.

In the drawings, the relative sizes of elements, layers, and regions may be exaggerated for clarity. Additionally, the use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the illustrated shapes of regions, but are to include deviations in shapes that result from, for instance, manufacturing.

For example, an implanted region illustrated as a rectangle may have rounded or curved features and/or a gradient of implant concentration at its edges rather than a binary change from implanted to non-implanted region. Likewise, a buried region formed by implantation may result in some implantation in the region between the buried region and the surface through which the implantation takes place.

Thus, the regions illustrated in the drawings are schematic in nature and their shapes are not intended to illustrate the actual shape of a region of a device and are not intended to be limiting. Additionally, as those skilled in the art would realize, the described embodiments may be modified in various ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form to avoid unnecessarily obscuring various embodiments.

Spatially relative terms, such as "beneath," "below," "lower," "lower side," "under," "above," "upper," "upper side," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below," "beneath," or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. Similarly, when a first part is described as being arranged "on" a second part, this indicates that the first part is arranged at an upper side or a lower side of the second part without the limitation to the upper side thereof on the basis of the gravity direction.

Further, the phrase "in a plan view" means when an object portion is viewed from above, and the phrase "in a schematic cross-sectional view" means when a schematic cross-section taken by vertically cutting an object portion is viewed from the side. The terms "overlap" or "overlapped" mean that a first object may be above or below or to a side of a second object, and vice versa. Additionally, the term "overlap" may include layer, stack, face or facing, extending over, covering, or partly covering or any other suitable term as would be appreciated and understood by those of ordinary skill in the art. The expression "not overlap" may include meaning, such as "apart from" or "set aside from" or "offset from" and any other suitable equivalents as would be appreciated and understood by those of ordinary skill in the art. The terms "face" and "facing" may mean that a first object may directly or indirectly oppose a second object. In a case in which a third object intervenes between a first and second object, the first and second objects may be understood as being indirectly opposed to one another, although still facing each other.

It will be understood that when an element, layer, region, or component is referred to as being "formed on," "on," "connected to," or "(operatively or communicatively) coupled to" another element, layer, region, or component, it can be directly formed on, on, connected to, or coupled to the other element, layer, region, or component, or indirectly formed on, on, connected to, or coupled to the other element, layer, region, or component such that one or more intervening elements, layers, regions, or components may be present. In addition, this may collectively mean a direct or indirect coupling or connection and an integral or non-integral coupling or connection. For example, when a layer, region, or component is referred to as being "electrically connected" or "electrically coupled" to another layer, region, or component, it can be directly electrically connected or coupled to the other layer, region, and/or component or intervening layers, regions, or components may be present. However, "directly connected/directly coupled," or "directly on," refers to one component directly connecting or coupling another component, or being on another component, without an intermediate component. In addition, in the present specification, when a portion of a layer, a film, an area, a plate, or the like is formed on another portion, a forming direction is not limited to an upper direction but includes forming the portion on a side surface or in a lower direction. On the contrary, when a portion of a layer, a film, an area, a plate, or the like is formed "under" another portion, this includes not only a case where the portion is "directly beneath" another portion but also a case where there is further another portion between the portion and another portion. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

For the purposes of this disclosure, expressions such as "at least one of," or "any one of," when preceding a list of elements, modify the entire list of elements and do not modify the individual elements of the list. For example, "at least one of X, Y, and Z," "at least one of X, Y, or Z," "at least one selected from the group consisting of X, Y, and Z," and "at least one selected from the group consisting of X, Y, or Z" may be construed as X only, Y only, Z only, any combination of two or more of X, Y, and Z, such as, for instance, XYZ, XYY, YZ, and ZZ, or any variation thereof. Similarly, the expression such as "at least one of A and B" and "at least one of A or B" may include A, B, or A and B. As used herein, "or" generally means "and/or," and the term "and/or" includes any and all combinations of one or more of the associated listed items. For example, the expression such as "A and/or B" may include A, B, or A and B. Similarly, expressions such as "at least one of," "a plurality of," "one of," and other prepositional phrases, when preceding a list of elements, modify the entire list of elements and do not modify the individual elements of the list.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure. The description of an element as a "first" element may not require or imply the presence of a second element or other elements. The terms "first," "second," etc. may also be used herein to differentiate different categories or sets of elements. For conciseness, the terms "first," "second," etc. may represent "first-category (or first-set)," "second-category (or second-set)," etc., respectively.

The terminology used herein is for the purpose of describing particular embodiments only and is not intended to be limiting of the present disclosure. As used herein, the singular forms "a" and "an" are intended to include the plural forms as well, while the plural forms are also intended to include the singular forms, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof.

When one or more embodiments may be implemented differently, a specific process order may be performed differently from the described order. For example, two consecutively described processes may be performed substantially at the same time or performed in an order opposite to the described order.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
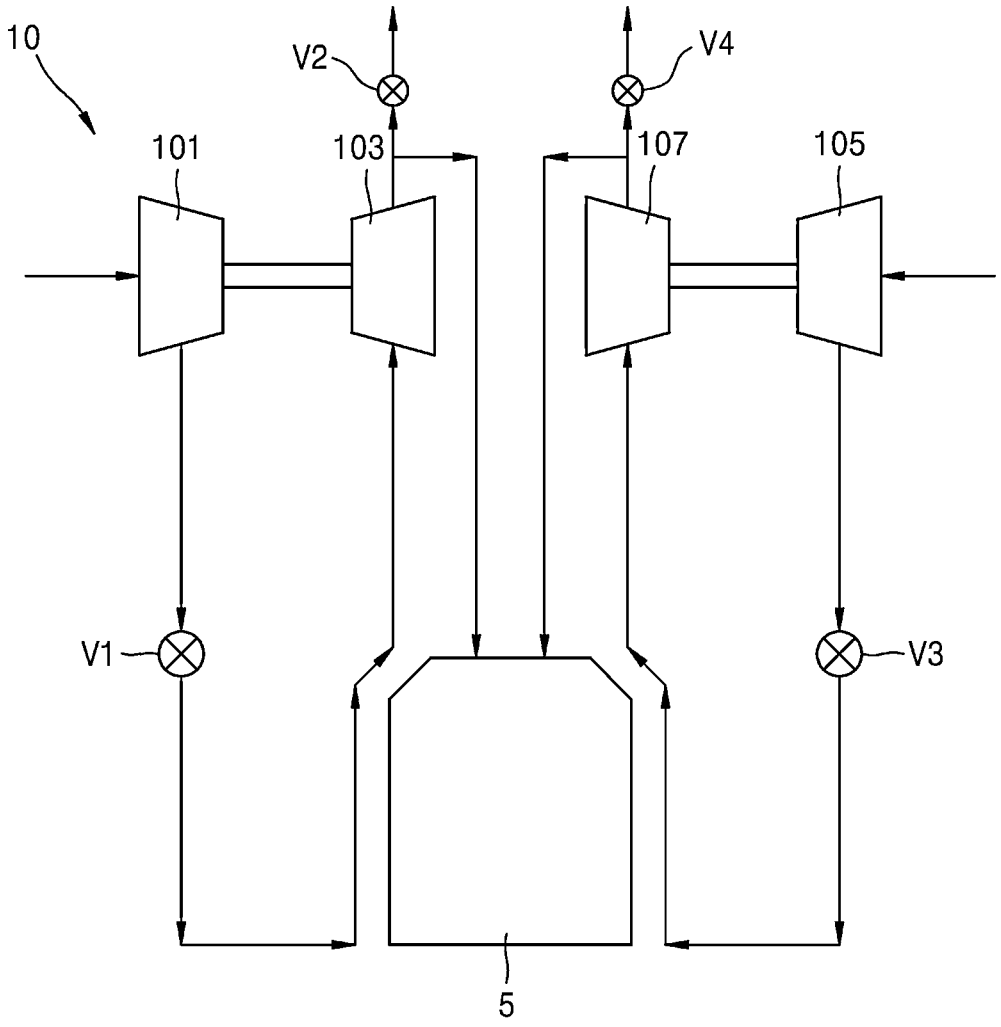
FIGS. 2 and 3 are views schematically illustrating a turbopump and a combustion chamber according to embodiments.
Figure 3:
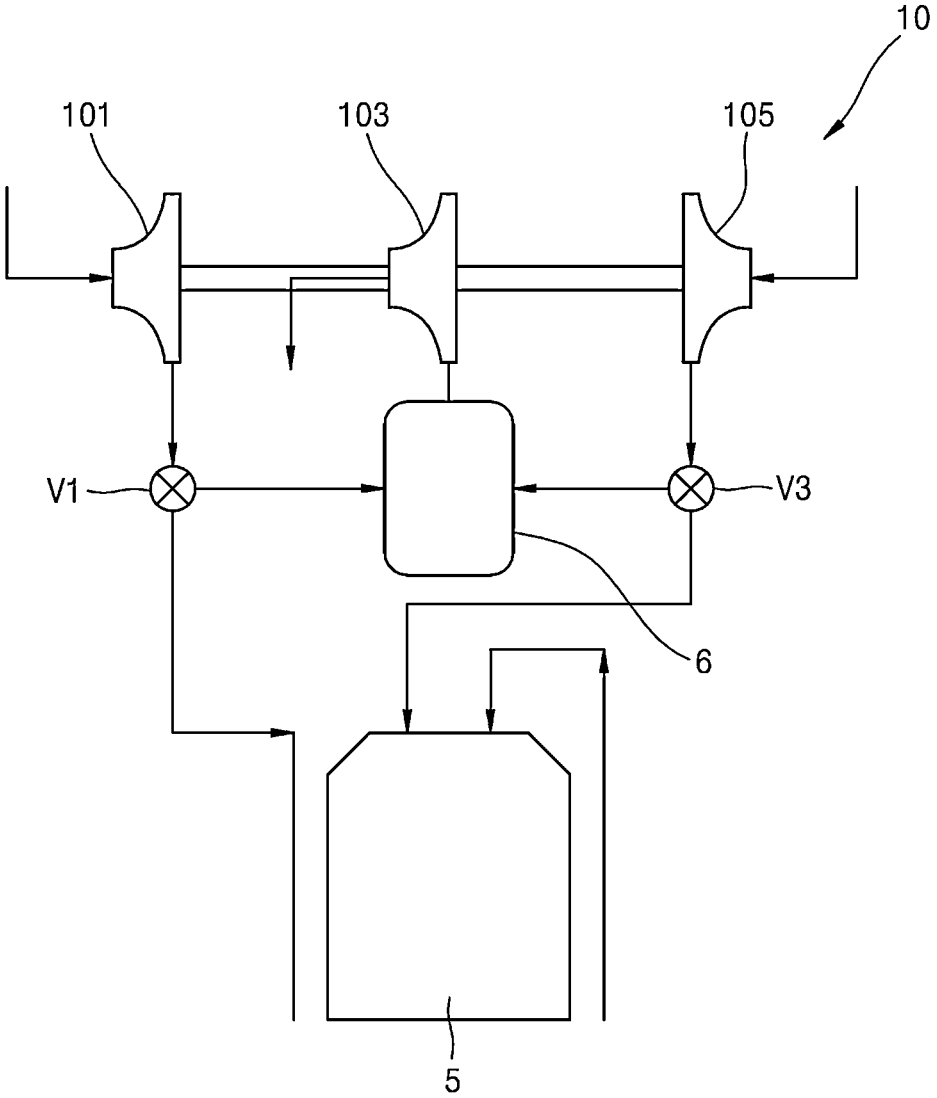
Figure 4:
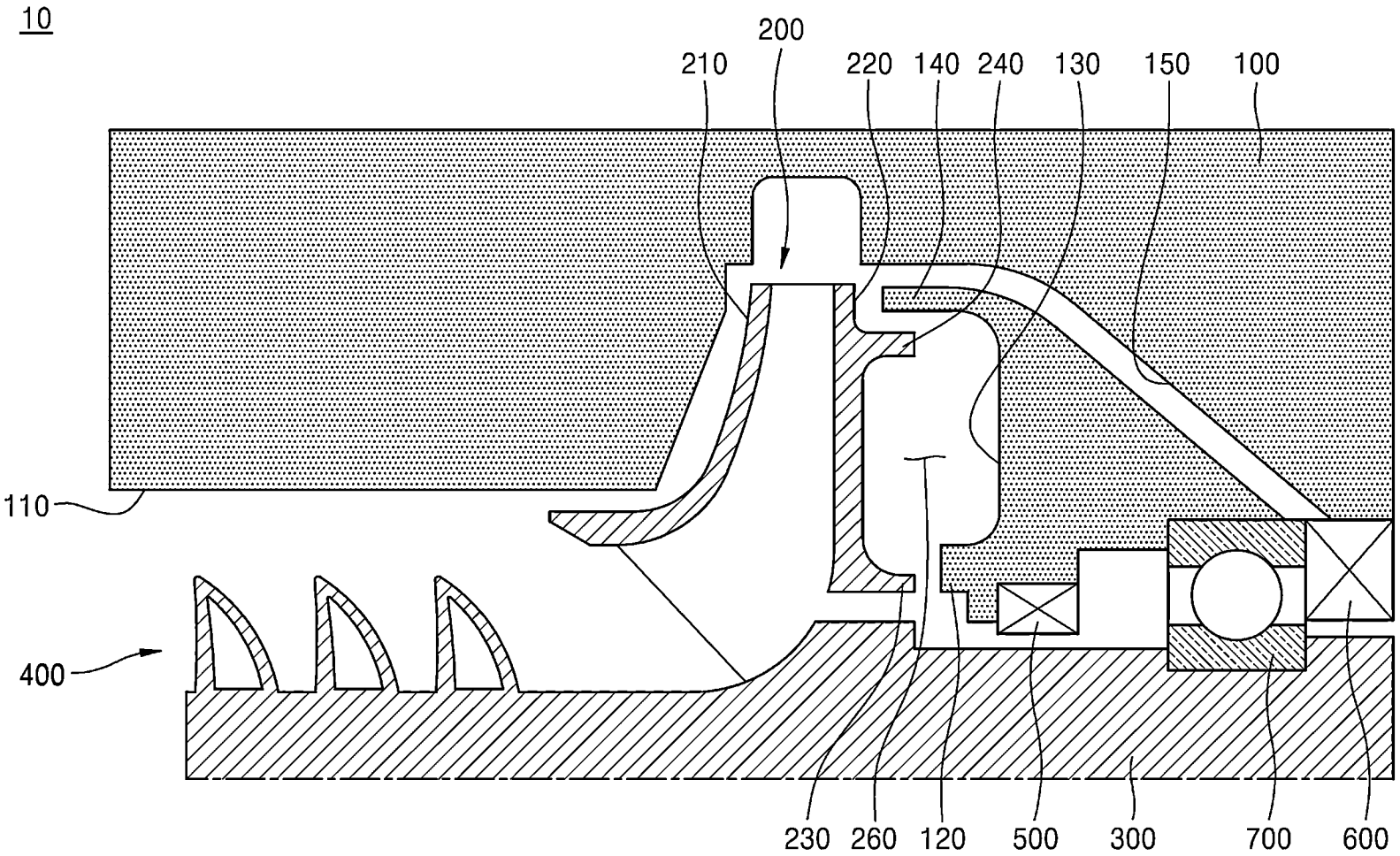
FIG. 4 is a cross-sectional view illustrating a turbopump according to embodiments.
Figure 5:
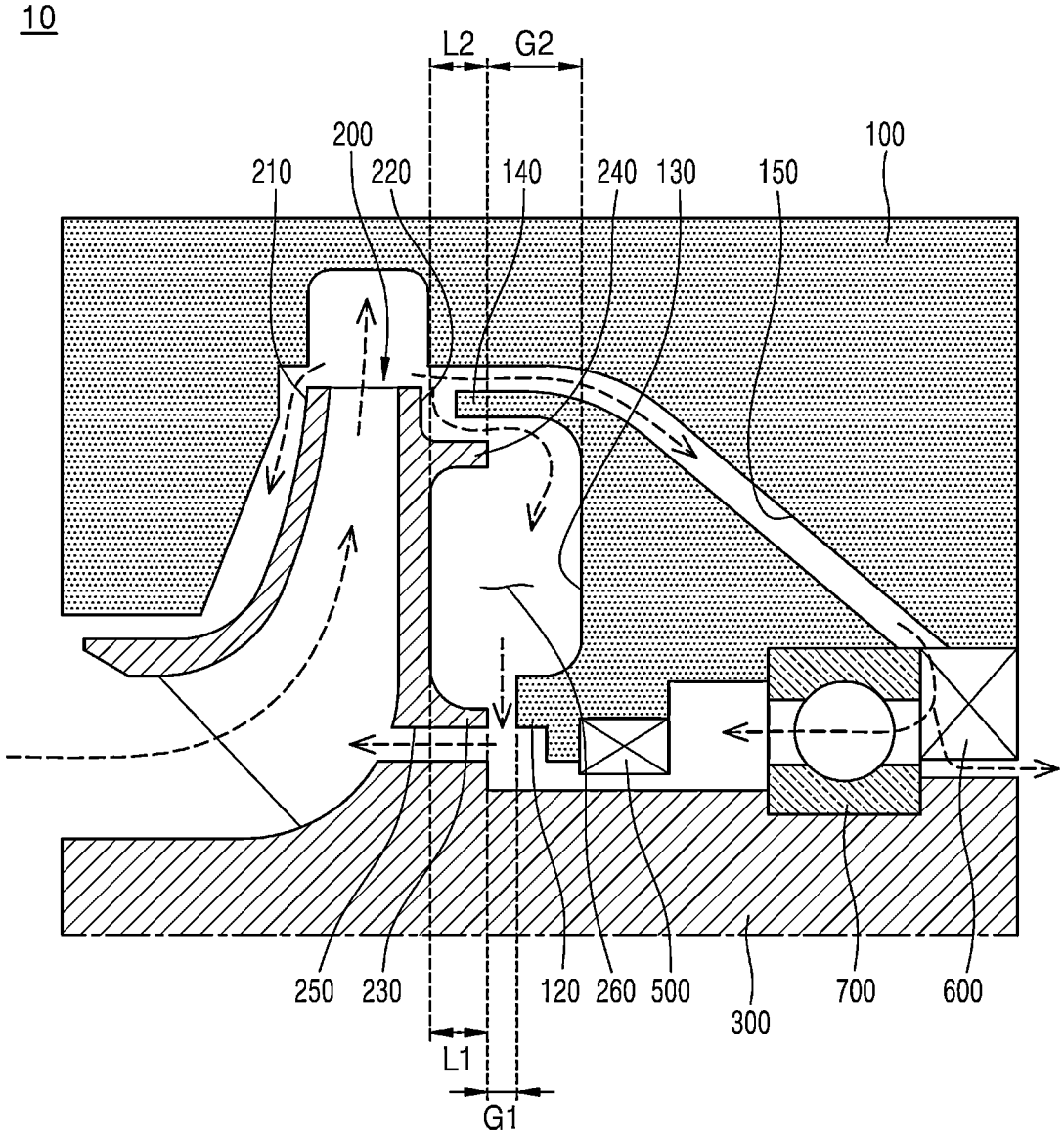
FIGS. 5, 6, and 7 are views illustrating operating states of a turbopump according to embodiments.
Figure 6:
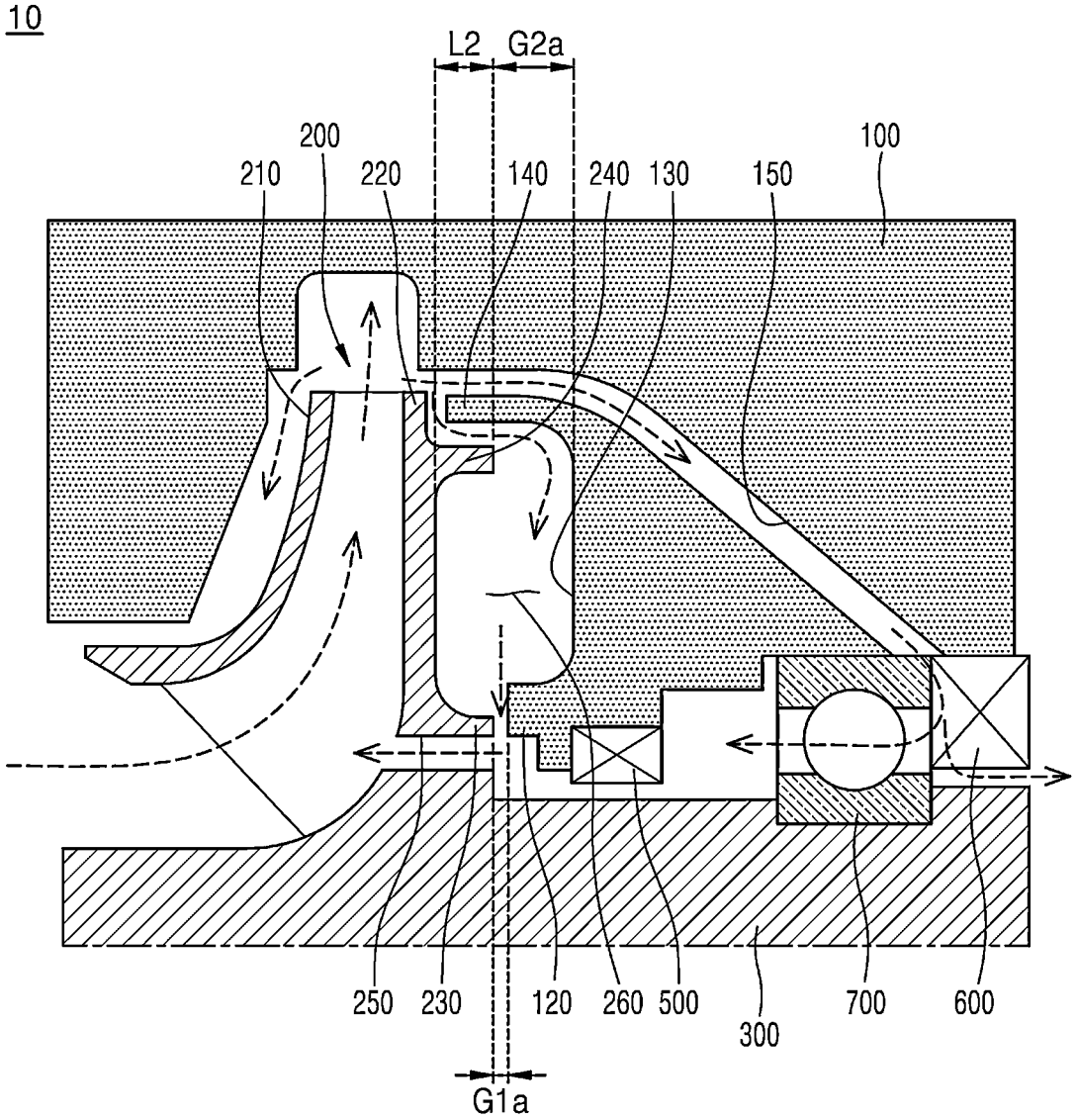
Figure 7:
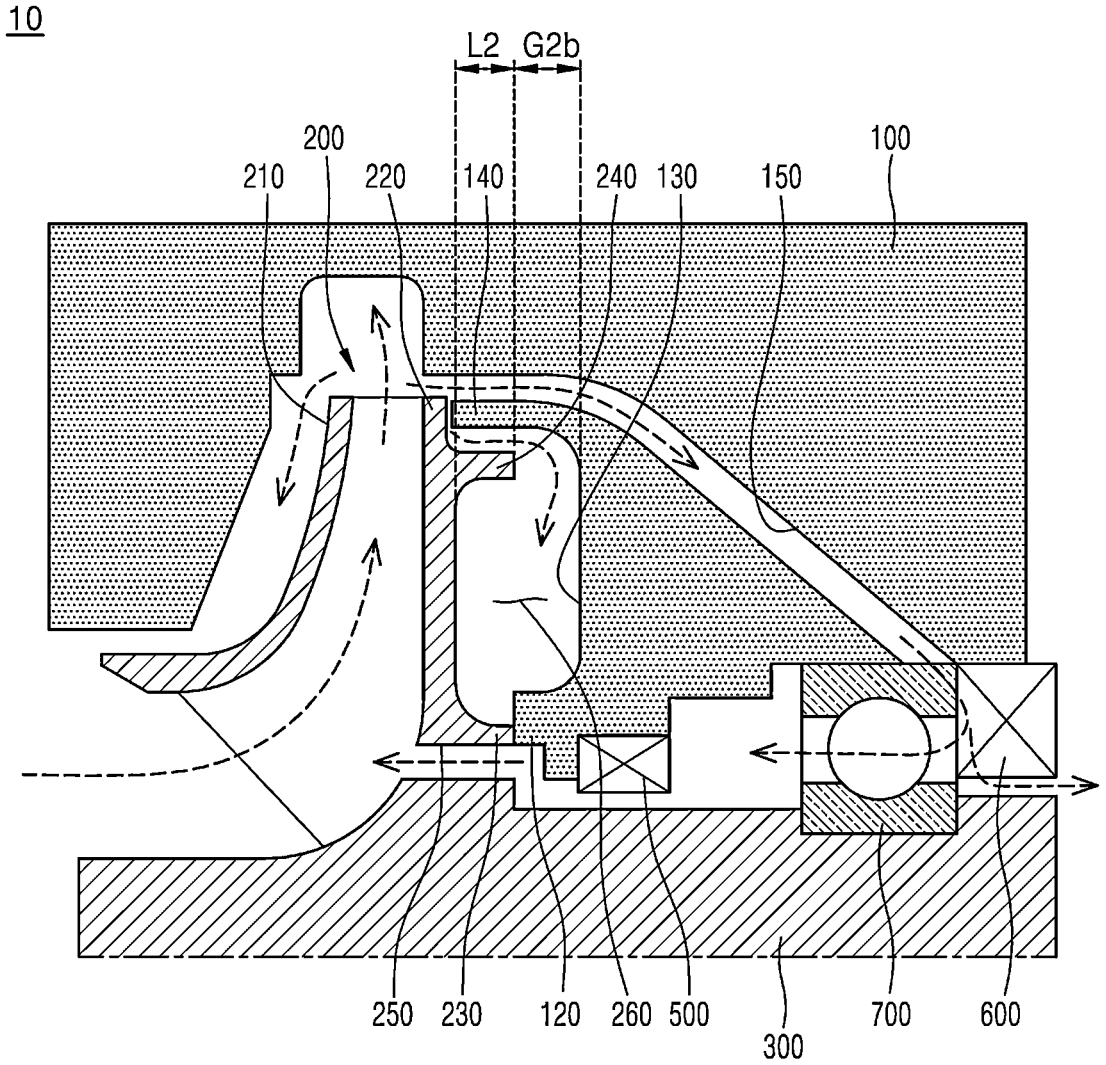
Figure 8:
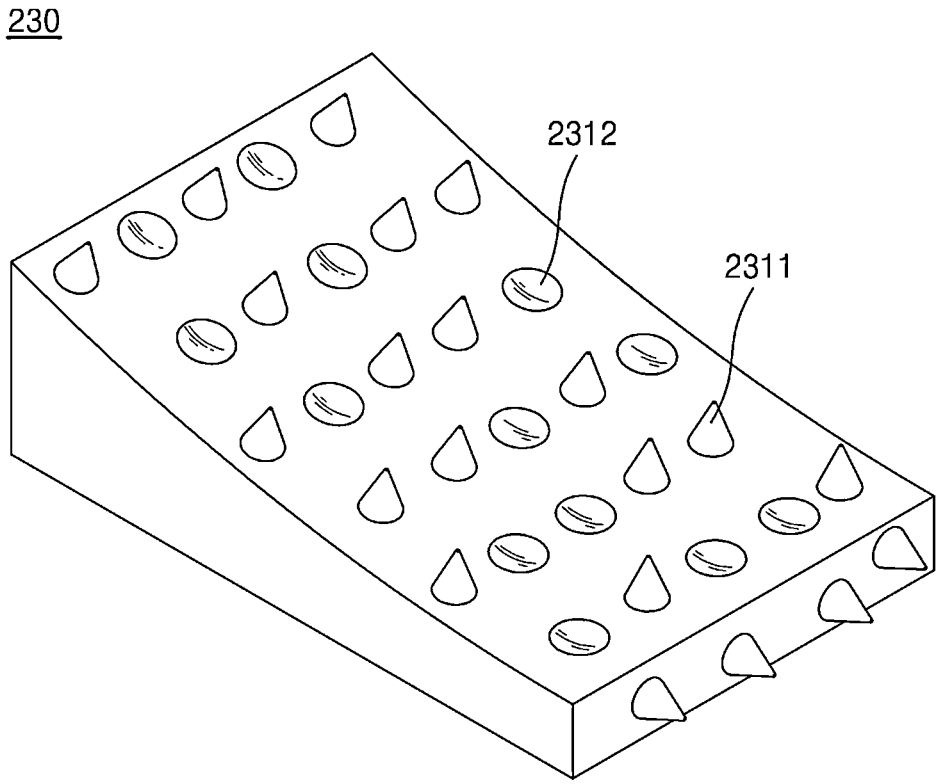
FIG. 8 is an enlarged view illustrating a protrusion according to embodiments.

FIG. 1 is a view schematically illustrating a rocket 1 including a turbopump 10 according to embodiments, FIGS. 2 and 3 are views schematically illustrating the turbopump 10 and a combustion chamber 5 according to embodiments, FIG. 4 is a cross-sectional view illustrating the turbopump 10 according to embodiments, FIGS. 5, 6, and 7 are views illustrating operating states of the turbopump 10 according to embodiments, and FIG. 8 is an enlarged view illustrating a first protrusion 230 according to embodiments.

The turbopump 10 is for pressurizing fuel and sending the fuel to an engine or the like. The turbopump 10 may be a centrifugal turbopump. In one or more embodiments, the turbopump 10 may be included in the rocket 1 and may be a rocket engine pump configured to pressurize a propellant (fuel and oxidizer) to a required pressure (for example, tens to hundreds of atmospheres) and supply the propellant to the combustion chamber 5. The turbopump 10 may be provided inside a main body 2 of the rocket 1 and may be connected to a fuel tank 3 and an oxidizer tank 4. The turbopump 10, which is formed as one turbopump, may receive fuel and oxidizer from the fuel tank 3 and the oxidizer tank 4, pressurize the fuel and the oxidizer, and supply the fuel and the oxidizer to the combustion chamber 5. Alternatively, the turbopump 10 may include two turbopumps. One of the two turbopumps may be connected to the fuel tank 3 to pressurize the fuel and supply the fuel to the combustion chamber 5, and the other may be connected to the oxidizer tank 4 to pressurize the oxidizer and supply the oxidizer to the combustion chamber 5.

As shown in FIG. 1, the fuel tank 3 and the oxidizer tank 4 may be positioned in a front portion of the main body 2 of the rocket 1, and the turbopump 10 and the combustion chamber 5 may be sequentially positioned rearward of the fuel tank 3 and the oxidizer tank 4. The fuel and the oxidizer may each be solid, liquid, or of a hybrid type in which a solid and a liquid are mixed with each other. For example, the fuel may include metal aluminum powder and magnesium powder, and the oxidizer may include ammonium perchlorate ($NH_4ClO_4$) and ammonium nitrate ($NH_4NO_3$). A binder may be added to assist mixing of the fuel and the oxidizer. Alternatively, the fuel may include at least one selected from the group consisting of kerosene, liquid hydrogen ($H_2$), unsymmetrical dimethylhydrazine (UDMH), hydrazine ($N_2H_4$), and the oxidizer may include at least one selected from the group consisting of liquid oxygen ($O_2$), nitrate ($KNO_3$), and dinitrogen tetroxide ($N_2O_4$). Alternatively, the fuel may include hydroxyl-terminated polybutadiene (HTPB), and the oxidizer may be at least one selected from the group consisting of liquid oxygen and nitrogen dioxide. The fuel tank 3 and the oxidizer tank 4 may be connected to the turbopump 10 through different passages, and the turbopump 10 may pressurize the fuel and the oxidizer supplied from the fuel tank 3 and the oxidizer tank 4 and send the fuel and the oxidizer to the combustion chamber 5. Alternatively, the turbopump 10 may be a vacuum pump for creating or maintaining a vacuum state in a chamber or container in a semiconductor or display manufacturing process.

As shown in FIG. 2, the turbopump 10 may include two turbopumps. One of the two turbopumps may include a first pump unit 101 and a first turbine unit 103, and the other may include a second pump unit 105, and a second turbine unit 107. The first pump unit 101 and the first turbine unit 103 may receive the fuel from the fuel tank 3, pressurize the fuel, and deliver the fuel to the combustion chamber 5, and the second pump unit 105 and the second turbine unit 107 may receive the oxidizer from the oxidizer tank 4, pressurize the oxidizer, and deliver the oxidizer to the combustion chamber 5. The first pump unit 101 and the first turbine unit 103 may be connected to each other through a shaft that is independent of a shaft through which the second pump unit 105 and the second turbine unit 107 are connected to each other.

The fuel supplied to the first pump unit 101 is pressurized such that when the fuel passes through the first turbine unit 103, power for driving the first pump unit 101 may be generated. Then, the fuel may flow into the combustion chamber 5. In this process, after passing through the first pump unit 101, the fuel may be depressurized or adjusted in flow rate while passing through a first valve V1. In addition, after passing through the first pump unit 101, the fuel may cool the combustion chamber while flowing along an outer surface of the combustion chamber 5 and may then flow into the first turbine unit 103. After passing through the first turbine unit 103, a portion of the fuel may flow into the combustion chamber 5, and the rest of the fuel may pass through a second valve V2 and flow to the outside of the turbopump 10.

The oxidizer supplied to the second pump unit 105 is pressurized, such that when the oxidizer passes through the second turbine unit 107, power for driving the second pump unit 105 may be generated. Then, the oxidizer may flow into the combustion chamber 5. In this process, after passing through the second pump unit 105, the oxidizer may be depressurized or adjusted in flow rate while passing through a third valve V3. In addition, after passing through the second pump unit 105, the oxidizer may cool the combustion chamber 5 while flowing along the outer surface of the combustion chamber 5 and may then flow into the second turbine unit 107. After passing through the second turbine unit 107, a portion of the oxidizer may flow into the combustion chamber 5, and the rest of the oxidizer may pass through a fourth valve V4 and flow to the outside of the turbopump 10.

Alternatively, the turbopump 10 may include two pump units and one turbine unit that share a single shaft. As shown in FIG. 3, the turbopump 10 may include a first pump unit 101, a first turbine unit 103, and a second pump unit 105 that are positioned on a single shaft. The first pump unit 101 may be supplied with the fuel, and the second pump unit 105 may be supplied with the oxidizer.

The fuel supplied to the first pump unit 101 may be pressurized and directed to a first valve V1. Then, a portion of the fuel may cool the combustion chamber 5 while flowing along the outer surface of the combustion chamber 5. In addition, the rest of the fuel may flow into a preburner 6 and then into the first turbine unit 103 to generate power.

In addition, the oxidizer supplied to the second pump unit 105 may be pressurized and directed to a third valve V3. Then, a portion of the oxidizer may flow into the combustion chamber 5. In addition, the rest of the oxidizer may flow into the preburner 6 and then into the first turbine unit 103 to generate power.

Hereinafter, the configuration of the turbopump 10 is described with reference to the accompanying drawings. For case of illustration, a pump unit of the turbopump 10 is mainly described, and a turbine unit of the turbopump 10 is not described in detail. The pump unit may be a device for pressurizing fluid (for example, fuel or oxidizer). The pump unit may be the first pump unit 101 or the second pump unit 105. The turbine unit may include a turbine that generates power for driving the pump unit. The turbine unit may be the first turbine unit 103 or the second turbine unit 107. When the turbopump 10 is for a rocket engine, the fluid may be fuel or oxidizer.

Alternatively, when the turbopump 10 is for a vacuum process in semiconductor or display manufacturing, the turbopump 10 may be used to discharge gas and other byproducts from the inside of a chamber. In this case, the turbopump 10 may not be included in the rocket 1.

The turbopump 10 may include a casing 100, an impeller 200, a rotational shaft 300, an inducer 400, a first seal 500, a second seal 600, and a bearing 700. In one or more embodiments, the turbopump 10 may include the casing 100, the rotational shaft 300 rotatably supported in the casing 100, and the impeller 200 mounted on a side of the rotational shaft 300 to pressurize fluid entering from an inlet 110 of the casing 100, wherein a clearance between the impeller 200 and the casing 100 varies in an axial direction according to a pressure difference between the front and rear sides of the impeller 200 such that the axial thrust of the turbopump 10 may be controlled.

The casing 100 may contain other components of the turbopump 10 to protect the other components from external shocks or foreign substances. The casing 100 may contain the rotational shaft 300, the impeller 200 connected toward the rotational shaft 300, and the inducer 400 connected to the rotational shaft 300. The casing 100 may also include passages through which fuel or oxidizer flows. For example, the casing 100 may include: the inlet 110 through which fuel or oxidizer flows into the casing 100; a first projection 120 and a second projection 140 that face a rear shroud 220 of the impeller 200; an opposing surface 130 forming an internal space 260 to accommodate fuel or oxidizer between the opposing surface 130 and the rear shroud 220 of the impeller 200; and a first channel 150 through which fuel or oxidizer flows to the turbine unit. In one or more embodiments, the casing 100 may further include the first projection 120 extending from a side of the opposing surface 130 toward the first protrusion 230.

The inlet 110 may be provided in a leading end of the casing 100, that is, a front side of the casing 100, to introduce fuel or oxidizer. The inlet 110 may be formed in a circular shape, and fuel or oxidizer entering through the inlet 110 may flow into the impeller 200 through the inducer 400.

The first projection 120 faces the rear shroud 220 of the impeller 200 and protrudes toward the rear shroud 220. As shown in FIG. 4, the first projection 120 may be provided adjacent to the rotational shaft 300 and may face the first protrusion 230 formed on a lower end of the rear shroud 220 in a radial direction (for example, a vertical direction in FIG. 4). The first projection 120 may protrude further than the opposing surface 130 in a forward direction (for example, a leftward length direction of the turbopump 10 or a leftward direction in FIG. 4). As the impeller 200 and the rotational shaft 300 move in the axial direction (for example, in the length direction of the turbopump 10 or a horizontal direction in FIG. 4) according to the flow rate of fuel or oxidizer flowing into the impeller 200, a gap between the first protrusion 230 and the first projection 120 varies, and the size of the internal space 260 between the rear shroud 220 and the opposing surface 130 also varies. Therefore, the pressure of fuel or oxidizer accommodated in the internal space 260 may vary, and thus, pressure exerted on the rear shroud 220 by the fuel or oxidizer in the forward direction of the turbopump 10 may also vary. As a result, the axial thrust of the turbopump 10 may be automatically adjusted. This is described later.

The opposing surface 130 may face the rear shroud 220, and the internal space 260 may be formed between the opposing surface 130 and the rear shroud 220. Fuel or oxidizer flowing into the impeller 200 is pressurized while being rotated and discharged through an upper side of the impeller 200 (refer to FIG. 4). A portion of the discharged fuel or oxidizer may flow into the combustion chamber 5, and the rest may flow into the internal space 260 along the rear shroud 220. The opposing surface 130 may be recessed toward a rear side of the turbopump 10 (for example, in a rightward direction in FIG. 4) and may thus be further rearward than ends of the first projection 120 and the second projection 140 in the turbopump 10.

The second projection 140 faces the rear shroud 220 of the impeller 200 and protrudes toward the rear shroud 220. In one or more embodiments, as shown in FIG. 4, the second projection 140 may be apart from the rotational shaft 300 in the radial direction (for example, in the vertical direction in FIG. 4). The second projection 140 may be located radially outward of the first projection 120. The second projection 140 may be adjacent to the first channel 150 and may face an upper end of the rear shroud 220 in the radial direction. The second projection 140 may form an inlet through which a portion of fuel or oxidizer flows inward between the second projection 140 and the rear shroud 220. Fuel or oxidizer may flow between the second projection 140 and the rear shroud 220 into the internal space 260. The second projection 140 may be adjacent to an outlet of the impeller 200, and thus, relatively high-pressure fuel or oxidizer may flow around the second projection 140. The pressure of fuel or oxidizer flowing around the second projection 140 may be greater than the pressure of fuel or oxidizer flowing around the first projection 120 or the first protrusion 230.

The first channel 150 may be a flow passage formed inside the casing 100 to allow a portion of high-pressure fuel or oxidizer discharged from the impeller 200 to flow therethrough. The first channel 150 may have an end connected to the outlet of the impeller 200 and may extend along the second projection 140 to a rear side of the opposing surface 130. The other end of the first channel 150 may be adjacent to the second seal 600 and the bearing 700.

The impeller 200 may be provided inside the casing 100 and may pressurize fuel or oxidizer entering the casing 100. In one or more embodiments, the impeller 200 may be provided at a leading end of the rotational shaft 300 and may rotate with the rotational shaft 300. The impeller 200 may pressurize fuel or oxidizer entering through the inducer 400 while rotating with the rotational shaft 300.

The impeller 200 may include a front shroud 210, the rear shroud 220, the first protrusion 230, a second protrusion 240, a second channel 250, and the internal space 260.

In one or more embodiments, the impeller 200 may include: the front shroud 210; the rear shroud 220 provided apart from the front shroud 210 in the axial direction (for example, the horizontal direction in FIG. 4) to form a passage for fluid to flow between the front shroud 210 and the rear shroud 220 and form the internal space with the casing 100; and the first protrusion 230 protruding from the rear shroud 220 in the axial direction to form a clearance with the casing 100. The casing 100 may include the opposing surface 130 facing the rear shroud 220 and forming the internal space 260 with the rear shroud 220.

The front shroud 210 may be provided at the front side of the impeller 200 and form a passage for fuel or oxidizer to flow between the front shroud 210 and the rear shroud 220. The front shroud 210 may extend radially outward (for example, upward in FIG. 4) and axially rearward (for example, rightward in FIG. 4) from behind the inducer 400. In one or more embodiments, the front shroud 210 may be shaped like a truncated cone that has a cross-section shape gradually widening in an axial rearward direction. In addition, the front shroud 210 may be apart from an inner surface of the casing 100. In addition, the front shroud 210 may be apart from the rotational shaft 300 in the radial direction to form a passage through which fuel or oxidizer flows inward.

The rear shroud 220 may face the front shroud 210 and may be provided axially rearward of the front shroud 210. The rear shroud 220 may be apart from the front shroud 210 to form a passage between the front shroud 210 and the rear shroud 220 for fuel or oxidizer to flow. Blades of the Impeller 200 may be provided in a flow passage between the front shroud 210 and the rear shroud 220. The flow passage may extend spirally in a circumferential direction, and fuel or oxidizer flowing into the flow passage may be pressurized while rotating at high speed along the flow passage. The rear shroud 220 may have a circular or ring shape parallel to the radial direction of the turbopump 10. The rear shroud 220 may be apart from the rotational shaft 300 in the radial direction to form the second channel 250 between the rear shroud 220 and the rotational shaft 300. As shown in FIG. 4, a portion of fuel or oxidizer that is pressurized while passing between the front shroud 210 and the rear shroud 220 may be discharged into a space between the impeller 200 and the casing 100 and may flow into the combustion chamber 5 through a passage (not shown).

The first protrusion 230 may protrude axially rearward from the rear shroud 220 and face the first projection 120 of the casing 100. The distance between the first protrusion 230 and the first projection 120 may be varied to control the flow rate of fuel or oxidizer flowing out from the internal space 260 and thus the pressure of the internal space 260. When the flow rate of fuel or oxidizer flowing into the impeller 200 increases, force pressing the impeller 200 and the rotational shaft 300 rearward may increase. Therefore, the impeller 200 and the rotational shaft 300 may move rearward, and the distance between the first protrusion 230 and the first projection 120 may decrease. As a result, fuel or oxidizer in a relatively high-pressure area around the outlet of the impeller 200 may flow into the internal space 260, and thus, the pressure of the internal space 260 may increase. In other words, the pressure exerted on the impeller 200 from the internal space 260 may increase. As a result, the impeller 200 and the rotational shaft 300 may move forward, increasing the distance between the first protrusion 230 and the first projection 120. Then, the pressure of the internal space 260 may decrease because fuel or oxidizer flows from the internal space 260 into a relatively low-pressure area around the impeller 200 and the rotational shaft 300. In this manner, the axial thrust of the turbopump 10 may be automatically adjusted as the impeller 200 and the rotational shaft 300 move axially according to the flow rate of fuel or oxidizer flowing into the impeller 200. The first protrusion 230 may have a length L1. The length L1 may be the length of the first protrusion 230 extending axially from one side of the rear shroud 220. In an initial state of the turbopump 10, the first protrusion 230 may be apart from the first projection 120 by a distance G1.

The first protrusion 230 may include a plurality of concave and convex portions on a surface thereof. As shown in FIG. 8, the first protrusion 230 may include a plurality of convex portions 2311 and a plurality of concave portions 2312 on the surface thereof. The convex portions 2311 and the concave portions 2312 may increase the surface roughness of the first protrusion 230, and owing to this, the flow rate of fuel or oxidizer discharged from the internal space 260 may be adjusted. For case of illustration, the convex portions 2311 and the concave portions 2312 are shown in FIG. 8 at a size visible to the naked eye, but embodiments are not limited thereto. For example, the convex portions 2311 and the concave portions 2312 may form fine convex-concave portions with sizes less than or equal to several millimeters (mm) or micrometers (μm). Alternatively, the surface roughness of the first protrusion 230 may be increased by a surface treatment such as laser processing.

The impeller 200 may further include the second protrusion 240 that is formed radially outward of the first protrusion 230 and protrudes axially from the rear shroud 220, and the casing 100 may further include the second projection 140 that extends toward the second protrusion 240 from the other side of the opposing surface 130.

The second protrusion 240 may protrude axially rearward from the rear shroud 220 and face the opposing surface 130 of the casing 100. For example, the second protrusion 240 may be provided radially inward of the second projection 140 (for example, below the second projection 140 in FIG. 4) and radially outward of the first protrusion 230 (for example, above the first protrusion 230 in FIG. 4). Because the second protrusion 240 is connected to the rear shroud 220, the second protrusion 240 may move together with the impeller 200 when the impeller 200 moves. Therefore, as in the description of the first protrusion 230, the impeller 200 may move according to the flow rate of fuel or oxidizer flowing into the impeller 200 and the flow rate of fuel or oxidizer flowing into the internal space 260. However, the distance between the second protrusion 240 and the opposing surface 130 is much greater than the distance between the first protrusion 230 and the casing 100, that is, the distance between the first protrusion 230 and the first projection 120, and thus, the effect of movement of the impeller 200 on the distance between the second protrusion 240 and the opposing surface 130 may be negligible. The second protrusion 240 may have a length L2. The length L2 may be the length of the second protrusion 240 extending axially from a side of the rear shroud 220. In an initial state of the turbopump 10, the second protrusion 240 may be apart from the opposing surface 130 by a distance G2. The length L2 may be equal to, greater than, or less than the length L1. In addition, the distance G2 may be greater than the distance G1. Therefore, even when an axial system, that is, a system including the impeller 200 and the rotational shaft 300, moves axially and the distance G1 becomes zero, the distance G2 is still greater than zero, allowing a certain amount of fuel or oxidizer discharged from the impeller 200 to always flow into the internal space 260.

For example, the distance G2 between the second protrusion 240 and the opposing surface 130 and the distance between the rear shroud 220 and the second projection 140 may be greater than the distance G1 between the first protrusion 230 and the casing 100, for example, the distance G1 between the first protrusion 230 and the first projection 120. For example, the second projection 140 may be located radially outward of the second protrusion 240.

A portion of fluid discharged from the impeller 200 may flow along the rear shroud 220, another portion of the fluid may flow along the first channel 150 formed in the casing 100, and the rest may flow along the front shroud 210. The impeller 200 may further include the second channel 250 formed radially inward of the first protrusion 230 between the rear shroud 220 and the rotational shaft 300.

The second channel 250 may be a flow passage formed by a clearance between the rear shroud 220 and the rotational shaft 300. For example, as shown in FIG. 4, the second channel 250 may be formed in a ring shape between the rear shroud 220 and the rotational shaft 300. The second channel 250 may be a balance hole formed in the impeller 200 and functioning as a return port. Axial thrust may be adjusted as fuel or oxidizer is discharged through the second channel 250.

The internal space 260 is formed between the impeller 200 and the casing 100, and as fuel or oxidizer discharged from the impeller 200 flows into the internal space 260, the internal space 260 may provide a force that presses the impeller 200 forward. For example, the internal space 260 may be a space formed between the rear shroud 220 and the opposing surface 130. When the turbopump 10 is in an initial state (for example, before fuel or oxidizer flows therein), the internal space 260 may be connected to the outside of the internal space 260 in the radial direction. In other words, a portion of fuel or oxidizer discharged from the impeller 200 may flow into the internal space 260 through a clearance between the rear shroud 220 and the second projection 140. In addition, fuel or oxidizer may be discharged from the internal space 260 through a clearance between the first protrusion 230 and the first projection 120. The pressure of the internal space 260 may vary according to the flow rate of fuel or oxidizer flowing into the impeller 200, that is, pressure pressing the impeller 200 rearward in the axial direction, such that pressure pressing the impeller 200 forward in the axial direction may also vary. For example, high-pressure fluid may be in an upper portion (or radially outward portion) of the internal space 260, and low-pressure fluid may be in a lower portion (or radially inward portion) of the internal space 260. Therefore, when an upper gap, for example, a gap between the rear shroud 220 and the second projection 140, is opened and a lower gap, for example, a gap between the rear shroud 220 and the first projection 120, is closed, the high-pressure fluid may fill the internal space 260, and the pressure of the internal space 260 may increase. When the upper gap, for example, the gap between the rear shroud 220 and the second projection 140, is closed and the lower gap, for example, the gap between the rear shroud 220 and the first projection 120, is opened. Then, as fluid flow out from the internal space 260 to a low-pressure area (e.g., the area below the internal space 260 in FIG. 5) through the lower gap, the pressure in the internal space 260 becomes equal to or similar to the pressure of the low-pressure area. Owing to this, the axial thrust of the turbopump 10 may be automatically adjusted.

For example, when a load caused by a fluid pressure on the front side of the impeller 200 is greater than a load caused by a fluid pressure on the rear side of the impeller 200, the impeller 200 and the rotational shaft 300 may move rearward, and when a load caused by a fluid pressure on the front side of the impeller 200 is less than a load caused by a fluid pressure on the rear side of the impeller 200, the impeller 200 and the rotational shaft 300 may move forward.

In addition, a rearward movement of the impeller 200 and the rotational shaft 300 may increase a load caused by a fluid pressure pressing the impeller 200 forward between the rear side of the impeller 200 and the casing 100, and a forward movement of the impeller 200 and the rotational shaft 300 may decrease a load caused by a fluid pressure pressing the impeller 200 forward between the rear side of the impeller 200 and the casing 100.

Furthermore, when a load caused by a fluid pressure on the front shroud 210 is greater than a load caused by a fluid pressure on the rear shroud 220, the impeller 200 and the rotational shaft 300 may move rearward, and a clearance between the first protrusion 230 and the casing 100 may decrease. In addition, when a load caused by a fluid pressure on the front shroud 210 is less than a load caused by a fluid pressure on the rear shroud 220, the impeller 200 and the rotational shaft 300 may move forward, and the clearance between the first protrusion 230 and the casing 100 may increase.

In addition, when a load caused by a fluid pressure on the front shroud 210 is greater than a load caused by a fluid pressure on the rear shroud 220, the impeller 200 and the rotational shaft 300 may move rearward, causing the first protrusion 230 to move toward and come into nearly contact with the first projection 120 and preventing fluid from being discharged from the internal space 260. As a result, high-pressure fluid may fill the internal space 260. In this specification, "nearly contact" may mean that the first protrusion 230 and the first projection 120 are very close to each other, obstructing the fluid flow but not actually touching. In the "nearly contact" state, the gap between the first protrusion 230 and the first projection 120 can be approximately 0.1 mm.

When a load caused by a fluid pressure on the front shroud 210 is less than a load caused by a fluid pressure on the rear shroud 220, the impeller 200 and the rotational shaft 300 may move forward, separating the first protrusion 230 from the first projection 120. Then, as fluid flow out from the internal space 260 to a low-pressure area (e.g., the area below the internal space 260 in FIG. 5) through the lower gap, the pressure in the internal space 260 becomes equal to or similar to the pressure of the low-pressure area.

The rotational shaft 300 may be provided inside the casing 100 and may extend in the length direction of the turbopump 10 (for example, the horizontal direction in FIG. 4). In addition, the rotational shaft 300 may be at a center of the turbopump 10 in the radial direction (for example, the vertical direction in FIG. 4). The rotational shaft 300 may connect the pump unit and the turbine unit of the turbopump 10 to each other and may rotate together with the turbine unit. As the rotational shaft 300 rotates, the pump unit, for example, the impeller 200, may rotate to pressurize fuel or oxidizer.

The inducer 400 may be provided on an outer surface of the rotational shaft 300 and may rotate together with the rotational shaft 300. For example, as shown in FIG. 4, the inducer 400 may be provided at the leading end of the rotational shaft 300 in the length direction of the turbopump 10 and may include one or more of inducers formed on the outer surface of the rotational shaft 300. The inducer 400 may prevent cavitation in which vapor bubbles form when the internal pressure of the turbopump 10 drops below the vapor pressure of fuel or oxidizer during the operation of the turbopump 10. For example, the inducer 400 may have a tail-wing-shaped cross-section such as a blade-shaped or a fin-shaped cross-section and may include a plurality of inducers formed in the length and circumferential directions of the rotational shaft 300. The inducer 400 may increase the pressure of fuel or oxidizer entering through the inlet 110, preventing cavitation and allowing the impeller 200 to pressurize fuel or oxidizer to a target pressure and a target flow rate.

The first seal 500 may be provided between the casing 100 and the rotational shaft 300 and may adjust a cooling flow rate for the bearing 700. For example, as a clearance between the first seal 500 and the rotational shaft 300 decreases, a flow rate through the bearing 700 may decreases, and as the clearance between the first seal 500 and the rotational shaft 300 increases, the flow rate through the bearing 700 may increase. For example, the first seal 500 may be provided axially forward of the bearing 700 and behind the first projection 120.

The second seal 600 may be provided between the casing 100 and the rotational shaft 300 to prevent fuel or oxidizer from flowing into the turbine unit. For example, the second seal 600 may be provided axially behind the bearing 700. In addition, the second seal 600 may be at an outlet side of the first channel 150. The second seal 600 may include an elastic member such as a spring and may be connected to the bearing 700. The second seal 600 may provide restoring force to keep the bearing 700 in an initial position between the casing 100 and the rotational shaft 300.

The bearing 700 may be provided between the casing 100 and the rotational shaft 300, supporting the rotational shaft 300 and reducing friction when the rotational shaft 300 rotates. For example, the bearing 700 may be provided axially between the first seal 500 and the second seal 600. The bearing 700 may be elastically supported by the second seal 600.

Next, a passage through which fuel or oxidizer flows into the turbopump 10 and an axial thrust balancing operation are described with reference to FIGS. 4 to 7.

Fuel or oxidizer flowing into the inlet 110 of the casing 100 may pass through the inducer 400 and flow into the impeller 200. The fuel or oxidizer may rotate at high speed while passing between the blades of the impeller 200 that are provided between the front shroud 210 and the rear shroud 220 and may then be discharged at high pressure from the impeller 200. A portion of the discharged fuel or oxidizer may flow into the combustion chamber 5 through a passage (not shown), and the rest may be discharged from the pump unit into the turbine unit after flowing between the front shroud 210 and the casing 100 and between the rear shroud 220 and the casing 100. A portion of fuel or oxidizer flowing between the rear shroud 220 and the casing 100 may be guide into the first channel 150, and the rest may be guided into the internal space 260. A portion of fuel or oxidizer flowing through the first channel 150 may partially balance axial thrust while returning to the inlet of the impeller 200 through the bearing 700 and the second channel 250, and the rest may be discharged from the pump unit to the turbine unit.

A portion of fuel or oxidizer discharged from the impeller 200 may flow into the internal space 260 through the clearance between the rear shroud 220 and the second projection 140. Fuel or oxidizer may flow into the internal space 260 through a clearance between the second protrusion 240 and the opposing surface 130 and may then be discharged from the internal space 260 into the second channel 250 through the clearance between the first protrusion 230 and the first projection 120.

FIG. 5 shows the turbopump 10 in an initial state before fuel flows into the turbopump 10. In this state, the distance between the first protrusion 230 and the first projection 120 may be G1, and the distance between the second protrusion 240 and the opposing surface 130 may be G2. In addition, the distance between the rear shroud 220 and the second projection 140 may be greater than G1.

In this state, when fuel or oxidizer flows into the impeller 200, the front-side pressure of the impeller 200 is greater than the rear-side pressure of the impeller 200. In this case, the direction of axial thrust is rearward, and as shown in FIG. 6, the impeller 200 and the rotational shaft 300 move rearward. The distance between the first protrusion 230 and the first projection 120 may decrease to G1*a*, and the distance between the second protrusion 240 and the opposing surface 130 may decrease to G2*a*. In this case, the distance between the rear shroud 220 and the second projection 140 may also decrease but may be greater than G1*a*. For example, the distance G2 and the distance between the rear shroud 220 and the second projection 140 may be much greater than G1*a*, and the distance G2 and the distance between the rear shroud 220 and the second projection 140 may not substantially affect axial thrust balancing. As a result, the amount of fluid flowing from the relatively high-pressure area into the internal space 260 may increase, and the amount of fluid flowing from the internal space 260 into the relatively low-pressure area may decrease. Thus, the pressure of the internal space 260 may increase.

When the state in which the front-side pressure of the impeller 200 is greater than the rear-side pressure of the impeller 200 continues, the impeller 200 and the rotational shaft 300 may move further rearward as shown in FIG. 7, causing the first protrusion 230 to come into nearly contact with the first projection 120. In other words, the clearance between the first protrusion 230 and the first projection 120 disappears. In addition, the distance between the second protrusion 240 and the opposing surface 130 further decreases to G2*b*. In this case, the distance between the rear shroud 220 and the second projection 140 further decreases but is much greater than zero, thereby having no effect on variations in the pressure of the internal space 260. As a result, fuel or oxidizer does not (or practically does not) flow outward from the internal space 260 but may only flow into the internal space 260. Therefore, the internal space 260 may be filled with fuel or oxidizer at high pressure.

When this state continues, a load caused by the pressure of the internal space 260 is greater than a load caused by the pressure of fuel or oxidizer on the front side of the impeller 200. In other words, a load caused by a pressure on the rear side of the impeller 200 is greater than a load caused by a pressure on the front side of the impeller 200, causing the impeller 200 and the rotational shaft 300 to move forward.

When the state in which a load caused by a pressure on the front side of the impeller 200 is less than a load caused by a pressure on the rear side of the impeller 200 continues, the impeller 200 and the rotational shaft 300 may move forward, increasing the distance between the first protrusion 230 and the first projection 120. As a result, the pressure of the internal space 260 may decrease, reducing the pressure on the rear side of the impeller 200, achieving thrust balancing, and stopping the movement of the impeller 200 and the rotational shaft 300.

In this manner, the pressure of the internal space 260, for example, the pressure on the rear side of the impeller 200, may be automatically adjusted according to the pressure of fuel or oxidizer flowing into the impeller 200, for example, according to the increase or decrease of the pressure on the front side of the impeller 200. Therefore, the turbopump 10 may automatically balance axial thrust without additional configurations.

FIGS. 9, 10, 11, and 12 show operating states of a turbopump 10A according to other embodiments.

The turbopump 10A shown in FIGS. 9, 10, 11, and 12 may include a casing 100A, an impeller 200A, a rotational shaft 300A, an inducer 400A, a first seal 500A, a second seal 600A, and a bearing 700A. The turbopump 10A may differ from the turbopump 10 in the structures of a second projection 140A and a second protrusion 240A. The other structures of the turbopump 10A are the same as those of the turbopump 10. "A" is added to the same reference numerals in the drawings, and detailed descriptions of the same structures are omitted.

Figure 9:
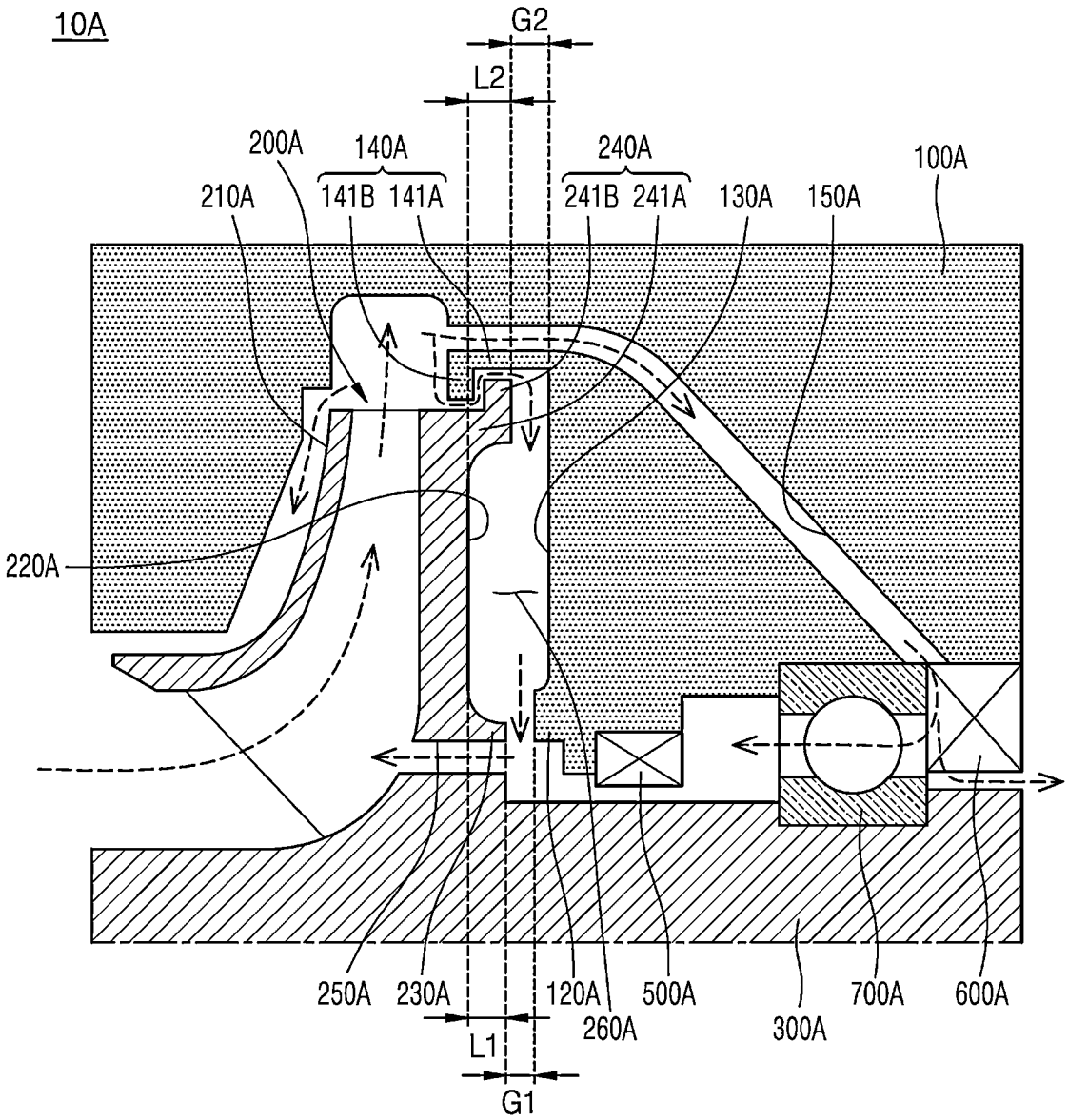
FIGS. 9, 10, 11, and 12 are views illustrating operating states of a turbopump according to other embodiments.

The second projection 140A may extend forward (for example, leftward in FIG. 9) from an opposing surface 130A. The second projection 140A may protrude forward from an upper end of the opposing surface 130A in the radial direction and may be apart from the second protrusion 240A. The second projection 140A may include portions extending in two different directions. For example, the second projection 140A may include a portion (first extension 141A) extending parallel to an axial direction and a portion (first end portion 141B) extending in a direction crossing the axial direction. As shown in FIG. 9, the second projection 140A may include a portion (first extension 141A) extending parallel to the axial direction from the opposing surface 130A and a portion (first end portion 141B) extending radially inward (for example, downward in FIG. 9) from the first extension 141A. Therefore, as shown in FIG. 9, the second projection 140A may overlap the second protrusion 240A at least partially in the axial and/or radial directions. The first extension 141A may extend forward axially from the casing 100A, and the first end portion 141B may extend radially inward from the first extension 141A.

The second protrusion 240A may extend rearward (for example, rightward in FIG. 9) from a rear shroud 220A. The second protrusion 240A may protrude rearward from an upper end of the rear shroud 220A in the radial direction and may form a clearance together with the second projection 140A. The second protrusion 240A may include portions extending in two different directions. For example, the second protrusion 240A may include a portion (second extension 241A) extending parallel to the axial direction and a portion (second end portion 241B) extending in a direction crossing the axial direction. As shown in FIG. 9, the second protrusion 240A may include a portion (second extension 241A) extending parallel to the axial direction from the rear shroud 220A and a portion (second end portion 241B) extending radially outward (for example, upward in FIG. 9) from the second extension 241A. Therefore, as shown in FIG. 9, the second protrusion 240A may overlap the second projection 140A at least partially in the axial and/or radial directions. The second extension 241A may extend rearward axially from the rear shroud 220A, and the second end portion 241B may extend radially outward from the second extension 241A.

As shown in FIG. 9, the first end portion 141B may overlap the second end portion 241B in the axial direction and the rear shroud 220A in the radial direction. Fluid discharged from the impeller 200A may flow into an internal space 260A through: a clearance between the first end portion 141B and the rear shroud 220A; a space formed by the first extension 141A, the first end portion 141B, the second extension 241A, and the second end portion 241B; and a clearance between the first extension 141A and the second end portion 241B.

Next, an axial thrust balancing operation of the turbopump 10A is described with reference to FIGS. 9 to 12.

FIG. 9 shows the turbopump 10A in an initial state before fuel flows into the turbopump 10A. In this state, the distance between a first protrusion 230A and a first projection 120A may be G1, and the distance between the second protrusion 240A and the opposing surface 130A may be G2 (for example, G2 may be the distance between the second end portion 241B and the opposing surface 130A). In addition, the distance between the rear shroud 220A and the second projection 140A may be greater than G1. The distance between a front surface (for example, a left surface in FIG. 9) of the second protrusion 240A and a rear surface (for example, a right surface in FIG. 9) of the second projection 140A may be less than or equal to G1.

Figure 10:
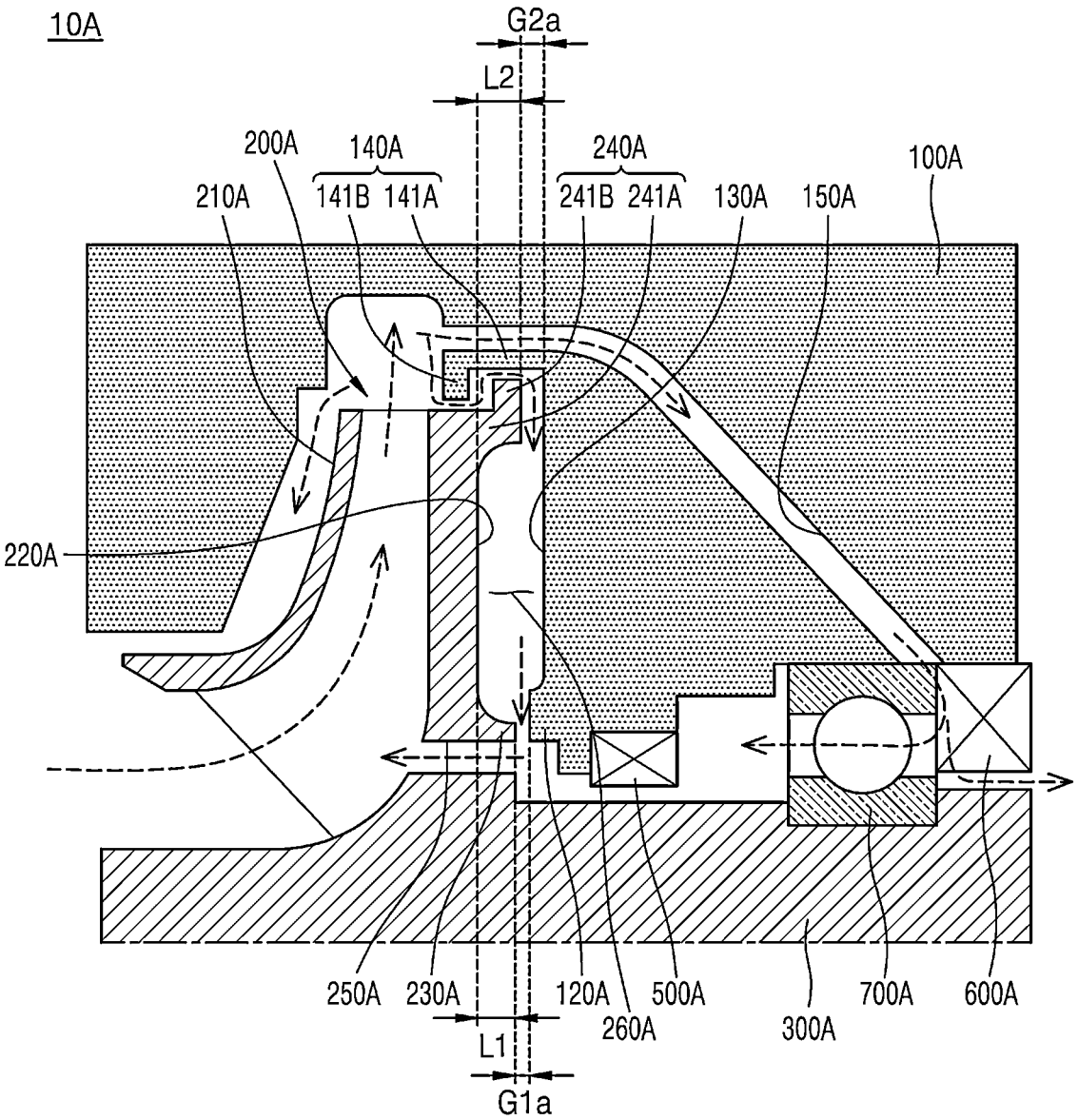

In this state, when fuel or oxidizer flows into the impeller 200A, a load caused by a pressure on a front side of the impeller 200A may be greater than a load caused by a pressure on a rear side of the impeller 200A. In this case, the direction of axial thrust is rearward, and as shown in FIG. 10, the impeller 200A and the rotational shaft 300A may move rearward. The distance between the first protrusion 230A and the first projection 120A may decrease to G1*a*, and the distance between the second protrusion 240A and the opposing surface 130A may decrease to G2*a*. At the same time, the distance between the front surface of the second protrusion 240A and the rear surface of the second projection 140A may increase. As a result, relatively high-pressure fuel or oxidizer may flow into the internal space 260A. Therefore, the pressure of the internal space 260A may increase. For example, because the distance between the front surface of the second protrusion 240A and the rear surface of the second projection 140A increases, high-pressure fuel or oxidizer may flow into the internal space 260A, and the pressure of the internal space 260A may increase.

Figure 11:
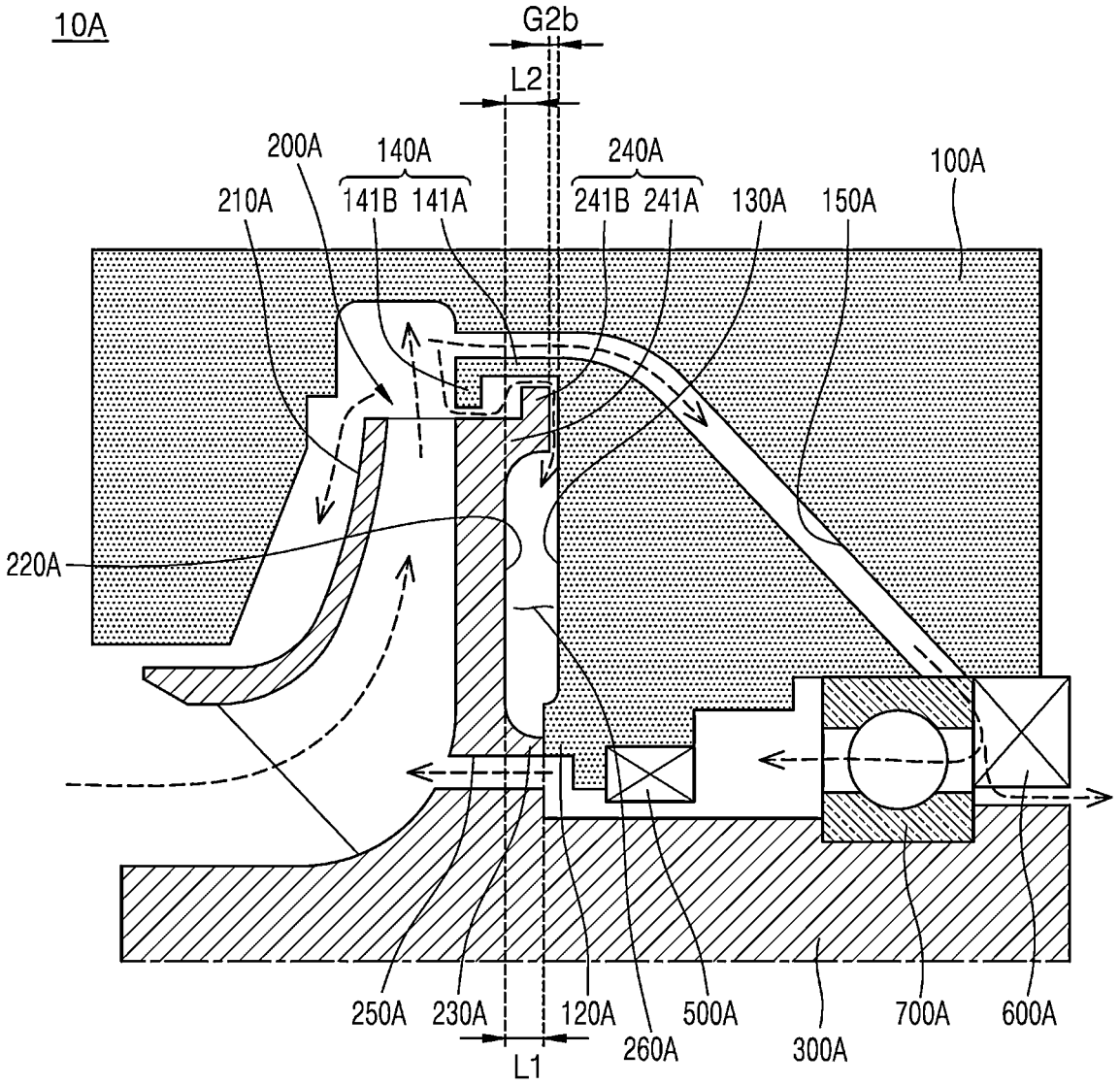

When the state in which a load caused by a pressure on the front side of the impeller 200A is greater than a load caused by a pressure on the rear side of the impeller 200A continues, as shown in FIG. 11, the impeller 200A and the rotational shaft 300A may move further rearward, causing the first protrusion 230A to come into nearly contact with the first projection 120A. In this specification, "nearly contact" may mean that the first protrusion 230A and the first projection 120A are very close to each other, obstructing the fluid flow but not actually touching. In the "nearly contact" state, the gap between the first protrusion 230A and the first projection 120A can be approximately 0.1 mm. In other words, a clearance between the first protrusion 230A and the first projection 120A may disappear. In addition, the distance between the second protrusion 240A and the opposing surface 130A may further decrease to G2*b*. However, G2*b* is much greater than G1*b*, substantially having no effect on axial thrust balancing. In this case, the distance between the front surface of the second protrusion 240A and the rear surface of the second projection 140A may also further increase. As a result, fuel or oxidizer does not (or practically does not) flow outward from the internal space 260A and may only flow into the internal space 260A. Therefore, the internal space 260A may be filled with fuel or oxidizer at high pressure. For example, because the distance between the front surface of the second protrusion 240A and the rear surface of the second projection 140A also increases, high-pressure fuel or oxidizer may flow into the internal space 260A, and the pressure of the internal space 260A may increase.

When this state continues, a load caused by the pressure of the internal space 260A is greater than a load caused by the pressure of fuel or oxidizer on the front side of the impeller 200A. In other words, a load caused by a pressure on the rear side of the impeller 200A is greater than a load caused by a pressure on the front side of the impeller 200A, causing the impeller 200A and the rotational shaft 300A to move forward.

Figure 12:
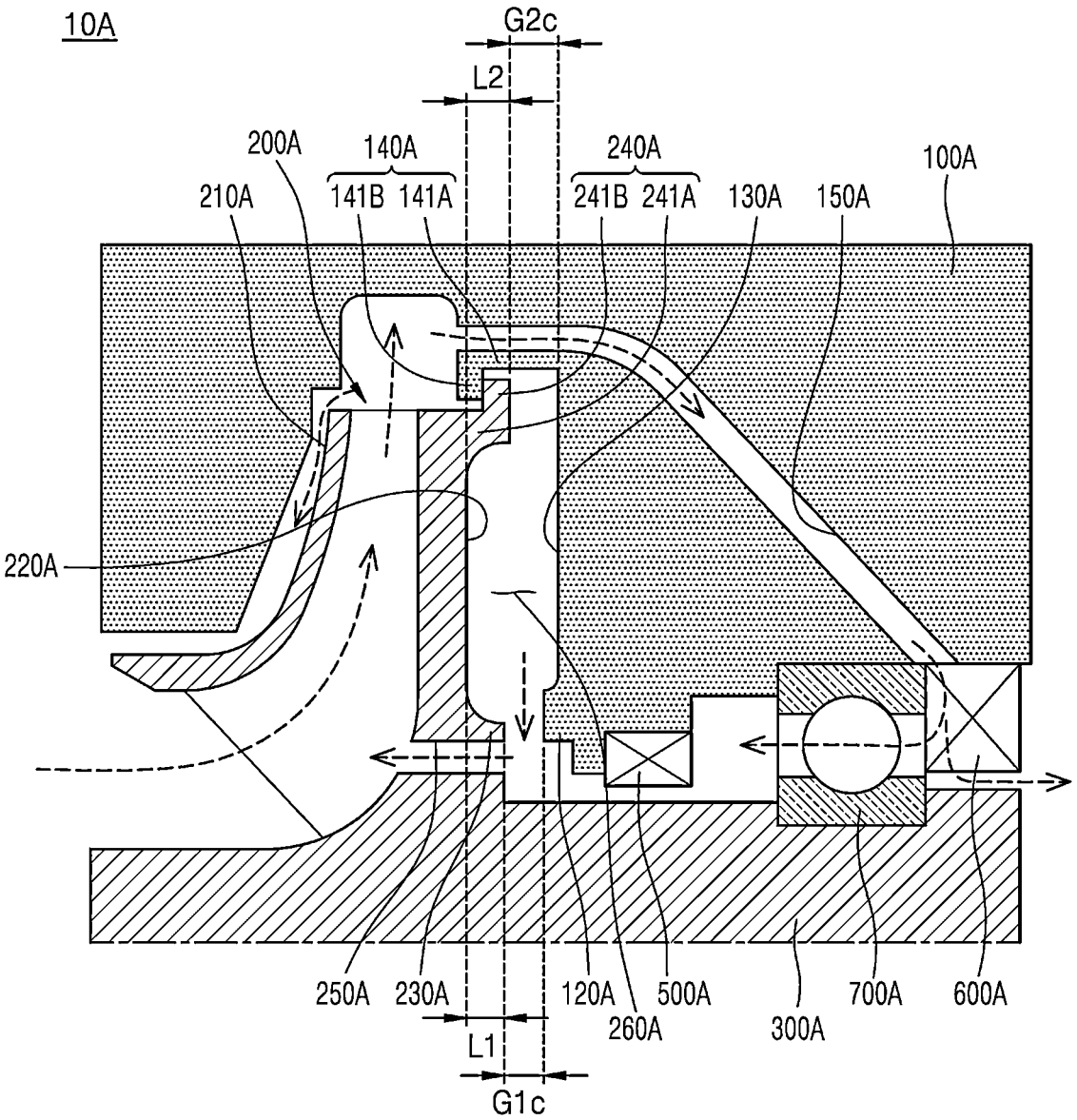

Conversely, when the state in which a load caused by a pressure on the front side of the impeller 200A is less than a load caused by a pressure on the rear side of the impeller 200A continues, as shown in FIG. 12, the impeller 200A and the rotational shaft 300A may move forward due to the pressure of the internal space 260A, increasing the distance between the first protrusion 230A and the first projection 120A to G1*c*. In addition, the distance between the second protrusion 240A and the opposing surface 130A may increase to G2*c*, and the distance between the front surface of the second protrusion 240A and the rear surface of the second projection 140A may decrease. Therefore, the flow rate of high-pressure fuel or oxidizer flowing into the internal space 260A may decrease, and the flow rate of low-pressure fuel or oxidizer communicating with the internal space 260A may increase, decreasing the pressure of the internal space 260A. In other words, as fluid flow out from the internal space 260A to a low-pressure area (e.g., the area below the internal space 260A in FIG. 9) through the lower gap, the pressure in the internal space 260A becomes equal to or similar to the pressure of the low-pressure area.

When the state in which a load caused by a pressure on the front side of the impeller 200A is less than a load caused by a pressure on the rear side of the impeller 200A continues, as shown in FIG. 12, the impeller 200A and the rotational shaft 300A may move further forward to increase the distance between the first protrusion 230A and the first projection 120A, and the front surface of the second protrusion 240A may come into nearly contact with the rear surface of the second projection 140A. For example, the first end portion 141B and the second end portion 241B may come into nearly contact with each other. In this specification, "nearly contact" may mean that the first end portion 141B and the second end portion 241B are very close to each other, obstructing the fluid flow but not actually touching. In the "nearly contact" state, the gap between the first end portion 141B and the second end portion 241B can be approximately 0.1 mm. In other words, a clearance between the front surface of the second protrusion 240A and the rear surface of the second projection 140A may disappear. Therefore, the pressure of the internal space 260A may decrease as fuel or oxidizer flow outward to a low-pressure area, and high-pressure fuel or oxidizer may not (or practically may not) flow into the internal space 260A. Therefore, the pressure of fuel or oxidizer accommodated in the internal space 260A may decrease faster. Thus, conversely to the previously described method, as the pressure of the internal space 260A decreases, the pressure on the rear side of the impeller 200A decreases, causing the impeller 200A and the rotational shaft 300A to move rearward.

For example, when a load caused by a fluid pressure on a front shroud 210A is greater than a load caused by a fluid pressure on the rear shroud 220A, the impeller 200A and the rotational shaft 300A move rearward, decreasing the amount of fluid discharged from the internal space 260A while increasing the amount of fluid flowing from the impeller 200A into the internal space 260A. In addition, when a load caused by a fluid pressure on the front shroud 210A is less than a load caused by a fluid pressure on the rear shroud 220A, the impeller 200A and the rotational shaft 300A move forward, increasing the amount of fluid discharged from the internal space 260A while decreasing the amount of fluid flowing from the impeller 200A into the internal space 260A.

For example, when a load caused by a fluid pressure on the front shroud 210A is greater than a load caused by a fluid pressure on the rear shroud 220A, the impeller 200A and the rotational shaft 300A move rearward, decreasing a clearance between the first protrusion 230A and the casing 100A while increasing the clearance between the front surface of the second protrusion 240A and the rear surface of the second projection 140A, and when a load caused by a fluid pressure on the front shroud 210A is less than a load caused by a fluid pressure on the rear shroud 220A, the impeller 200A and the rotational shaft 300A move forward, increasing the clearance between the first protrusion 230A and the casing 100A while decreasing the clearance between the front surface of the second protrusion 240A and the rear surface of the second projection 140A.

As described above, according to the one or more of the above embodiments, the turbopump may automatically balance axial thrust by adjusting the clearance between the impeller and the casing according to a fluid pressure difference applied to the impeller, thereby controlling axial thrust without using additional configurations.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A turbopump comprising:

a casing;

a rotational shaft rotatably supported on the casing; and an impeller mounted on a side of the rotational shaft and pressurizing a fluid flowing into the impeller from an inlet of the casing, the impeller including:

a front shroud, a rear shroud provided axially apart from the front shroud, forming a passage through which the fluid flows between the front shroud and the rear shroud, and forming an internal space with the casing, and a first protrusion protruding axially from the rear shroud and forming a clearance with the casing, a second protrusion protruding axially from the rear shroud and formed radially outward of the first protrusion, wherein axial thrust is controlled as the clearance formed between the impeller and the casing in a length direction of the rotational shaft varies according to a fluid pressure difference between front and rear sides of the impeller;

wherein the casing includes an opposing surface facing the rear shroud and forming the internal space with the rear shroud, and a projection extending from a side of the opposing surface toward the second protrusion, and wherein the projection includes:

a first extension extending axially forward from the casing, and a first end portion extending radially inward from the first extension, wherein the second protrusion includes:

a second extension extending axially rearward from the rear shroud, and a second end portion extending radially outward from the second extension;

wherein the second protrusion and the projection overlap each other in at least one of an axial direction and a radial direction, wherein the first end portion and the second end portion overlap each other in the axial direction, and the first end portion overlaps the rear shroud in the radial direction, wherein the fluid discharged from the impeller flows into the internal space through: a clearance between the first end portion and the rear shroud; a space formed by the first extension, the first end portion, the second extension, and the second end portion; and a clearance between the first extension and the second end portion.

2. The turbopump of claim 1, wherein when a load caused by a fluid pressure applied to the front side of the impeller is greater than a load caused by a fluid pressure applied to the rear side of the impeller, the impeller and the rotational shaft move rearward, and when the load caused by the fluid pressure applied to the front side of the impeller is less than the load caused by the fluid pressure applied to the rear side of the impeller, the impeller and the rotational shaft move forward.

3. The turbopump of claim 1, wherein when the impeller and the rotational shaft move rearward, a load caused by a pressure of the fluid pressing the impeller forward between the rear side of the impeller and the casing increases, and when the impeller and the rotational shaft move forward, the load caused by the pressure of the fluid pressing the impeller forward between the rear side of the impeller and the casing decreases.

4. The turbopump of claim 1, wherein when a load caused by a fluid pressure applied to the front shroud is greater than a load caused by a fluid pressure applied to the rear shroud, the impeller and the rotational shaft move rearward, and the clearance between the first protrusion and the casing decreases, and when the load caused by the fluid pressure applied to the front shroud is less than the load caused by the fluid pressure applied to the rear shroud, the impeller and the rotational shaft move forward, and the clearance between the first protrusion and the casing increases.

5. The turbopump of claim 1, wherein the casing further comprises another projection extending from a side of the opposing surface toward the first protrusion.

6. The turbopump of claim 5, wherein when a load caused by a fluid pressure applied to the front shroud is greater than a load caused by a fluid pressure applied to the rear shroud, the impeller and the rotational shaft move rearward, the first protrusion moves toward the another projection and comes into nearly contact with the another projection, and the fluid is not discharged from the internal space, and when the load caused by the fluid pressure applied to the front shroud is less than the load caused by the fluid pressure applied to the rear shroud, the impeller and the rotational shaft move forward, the first protrusion moves away from the another projection, and an amount of the fluid discharged from the internal space increases.

7. The turbopump of claim 1, wherein a gap between the second protrusion and the opposing surface and a gap between the rear shroud and the projection are greater than a gap between the first protrusion and the casing.

8. The turbopump of claim 1, wherein the projection is located radially outward of the second protrusion.

9. The turbopump of claim 1, wherein a portion of the fluid discharged from the impeller flows along the rear shroud, and another portion of the fluid discharged from the impeller flows along a first channel formed in the casing, and the impeller further comprises a second channel located radially inward of the first protrusion and formed between the rear shroud and the rotational shaft.

10. The turbopump of claim 1, wherein the first protrusion comprises a plurality of concave and convex portions on a surface thereof.

11. The turbopump of claim 1, wherein when a load caused by a fluid pressure applied to the front shroud is greater than a load caused by a fluid pressure applied to the rear shroud, the impeller and the rotational shaft move rearward, and an amount of the fluid discharged from the internal space decreases, and an amount of the fluid flowing from the impeller into the internal space increases, and when the load caused by the fluid pressure applied to the front shroud is less than the load caused by the fluid pressure applied to the rear shroud, the impeller and the rotational shaft move forward, the amount of the fluid discharged from the internal space increases, and the amount of the fluid flowing from the impeller into the internal space decreases.

12. The turbopump of claim 1, wherein when a load caused by a fluid pressure applied to the front shroud is greater than a load caused by a fluid pressure applied to the rear shroud, the impeller and the rotational shaft move rearward, a clearance between the first protrusion and the casing decreases, and a clearance between the protrusion and the second projection increases, and when the load caused by the fluid pressure applied to the front shroud is less than the load caused by the fluid pressure applied to the rear shroud, the impeller and the rotational shaft move forward, the clearance between the first protrusion and the casing increases, and the clearance between the second protrusion and the projection decreases.

13. The turbopump of claim 1, further comprising:

a first seal between the casing and the rotational shaft;

a second seal provided between the casing and the rotational shaft at a position different from a position of the first seal and comprising an elastic member; and a bearing provided between the casing and the rotational shaft at a position different from the position of the second seal and elastically supported by the second seal.

14. The turbopump of claim 13, wherein the second seal is axially rearward of the bearing and maintains the bearing in an initial position between the casing and the rotational shaft, and the bearing is between the first seal and the second seal in an axial direction.

* * * * *